US005376853A

United States Patent [19]

Fushimi

[11] Patent Number: 5,376,853

[45] Date of Patent: Dec. 27, 1994

[54] ELECTROACOUSTIC TRANSDUCER

[75] Inventor: Isao Fushimi, Shizuoka, Japan

[73] Assignee: Star Micronics Co., Ltd., Shizuoka, Japan

[21] Appl. No.: 951,113

[22] Filed: Sep. 25, 1992

[30] Foreign Application Priority Data

Sep. 28, 1991 [JP] Japan ..... 3-277114

[51] Int. Cl.[5] ..... H04R 17/00; H04R 1/20

[52] U.S. Cl. ..... 310/312; 310/324; 381/190

[58] Field of Search ..... 367/163, 174; 310/312, 310/324; 381/190, 191, 203; 340/384 E; 29/25.35

[56] References Cited

U.S. PATENT DOCUMENTS 4,211,947 7/1980 Ikeno et al. ..... 310/312
4,218,631 8/1980 Yamaguchi ..... 310/312
5,118,981 6/1992 Kobayashi et al. ..... 310/324

FOREIGN PATENT DOCUMENTS 51-43807 10/1976 Japan .
51-43808 10/1976 Japan .
60-220397 11/1985 Japan .
2166022 8/1985 United Kingdom .

*Primary Examiner*—Ian J. Lobo
*Attorney, Agent, or Firm*—Sughrue, Mion, Zinn, Macpeak & Seas

[57] ABSTRACT

Disclosed is an electroacoustic transducer which comprises a diaphragm including an elastic plate, an added mass secured to a center portion of the elastic plate. The added mass has a contact portion, which contacts the elastic plate and is shaped to provide a portion to allow for deformation of the elastic plate within an imaginary circle defined by connecting an outer surface portion of the contact portion. Thus, the contact portion can provide a deformable elastic-plate portion within that circle. In other words, it is possible to accomplish such a structure obtained as if by connecting different springs having different spring characteristics, located outside and inside the circle. This structure can suppress and stabilize a variation in resonance frequency ($f_0$) caused by a change in the amplitude of the diaphragm. The follow-up reproducibility of an output to an input is thus improved enough to cope with the case of using the electroacoustic transducer for AM sounds or attenuating sounds.

12 Claims, 12 Drawing Sheets

ELECTROACOUSTIC TRANSDUCER

BACKGROUND OF THE INVENTION

1. Field of the Invention

The present invention relates to an electroacoustic transducer, such as an electromagnetic type electroacoustic transducer or a piezo type electroacoustic transducer, and, more particularly, to an electroacoustic transducer which permits control of the spring characteristic of a diaphragm used therein to stabilize the resonance frequency ($f_0$), thereby improving the follow-up reproducibility of an output to an input.

2. Description of the Related Art

An electromagnetic type electroacoustic transducer may have a structure as shown in FIG. 30. This electroacoustic transducer has a case 1 and a base 3 located within the case 1 at the bottom portion in the diagram. A core 5 is mounted in the center of the base 3. A bobbin 7 is mounted outside the core 5, with a magnet wire 9 wound around the bobbin 7. Attached to the bobbin 7 are terminals 11 and 13 extending downwardly in the diagram. A plastic magnet 15 is disposed between the outer surface of the bobbin 7 and the inner wall of the case 1. The bottom surface of the base 3 is coated with a potting agent 17 to enhance the sealing performance.

An elastic plate 19 is disposed facing the core 5 in the case 1. This elastic plate 19 is adsorbed to the plastic magnet 15. A magnetic piece 21 as an added mass is attached to the center portion of the elastic plate 19. The elastic plate 19 and magnetic piece 21 constitute a diaphragm 20. The main purpose of attaching the magnetic piece 21 as an added mass is to set the frequency of an output sound lower by increasing the mass. A through hole 23 is provided in the center of the top of the case 1 in the diagram. A masking label 25 is provided to cover the through hole 23. The elastic plate 19 and magnetic piece 21 are constituted as shown in FIGS. 31 and 32. As apparent from those diagrams, the elastic plate 19 and magnetic piece 21 are shaped like a disk, the magnetic piece 21 secured at its center to the elastic plate 19 by spot welding. The securely welded portion is denoted by a numeral "27" in FIG. 31. The line specified by a numeral "29" in FIG. 31 is a mark to discriminate one side of the elastic plate 19 from the other. That is, one side of the elastic plate 19 has its edge portion rounded to have a roll-over face and the other side has its edge portion roughened to have a burr face. The magnetic piece 21 is attached to the roll-over face side of the elastic plate 19. The line or mark 29 is provided to discriminate the roll-over face from the burr face.

With the above structure, the elastic plate 19 is attracted and adsorbed to the plastic magnet 15, so that it is set to have a given polarity. When a current flows across the coil via the terminals 11 and 13 under this condition, the core 5 is electrically magnetized, generating a magnetic field at the distal end. At this time, when the magnetic field generated on the core 5 by the excited coil has a different polarity than the magnet-oriented polarity of the elastic plate 19, the elastic plate 19 is attracted to the core 5. When the polarity of the magnetic field of the core 5 is the same as that of the elastic plate 19, on the other hand, the elastic plate 19 moves away from the core 5. Intermittent current supply to the coil in a given direction causes the elastic plate 19 to repeat the up and down movement to the core 5, thus vibrating at a given frequency. This vibration generates a sound.

According to the conventional structure, however, the resonance frequency ($f_0$) does not become stable in some cases, thus lowering the output-to-input follow-up reproducibility. In other words, the compliance of the diaphragm 20 (the reciprocal of the spring constant or the spring characteristic of the diaphragm) is determined by the compliance of that portion of the elastic plate 19 which is not in contact with the magnetic piece 21, the state of the contact portion between the elastic plate 19 and the outer periphery of the magnetic piece 21, and the state of that portion which supports the elastic plate 19 (the state of the attracting/adsorbing structure by the plastic magnet 15 in the conventional structure). Further, tension is produced by the plastic magnet 15, on the elastic plate 19 around the outer periphery of the magnetic piece 21 and around the outer periphery of the elastic plate 19 which is supported by the attraction or adsorption of the plastic magnet 15. This tension makes the compliance smaller.

If the force of securing the outer surface portion of the diaphragm 20 by the attraction/adsorption of the plastic magnet 15 is strong enough, when the diaphragm 20 vibrates, the tension increases with an increase in the amplitude of the diaphragm 20 (an increase in the applied voltage) due to the aforementioned action. This reduces the compliance. That is, the spring constant of the diaphragm 20 gradually becomes greater. As the amplitude increases, therefore, the resonance frequency ($f_0$) rises as shown in FIG. 33, so that the spring characteristic of the diaphragm 20 becomes that of a hard spring system. If the force of securing the outer surface portion of the diaphragm 20 by the attraction/adsorption of the plastic magnet 15 is weak, on the other hand, the following will occur. When the amplitude of the diaphragm 20 increases, the outer periphery of the elastic plate 19 starts moving away from the plastic magnet 15 with the inner contact portion of the elastic plate 19 to the plastic magnet 15 being a fulcrum due to the small attraction/adsorption force. Accordingly, the tension decreases, resulting in temporary increase in the compliance. When the amplitude further increases later, the tension increases, causing the increased compliance to fall. This situation is illustrated in FIG. 34. In short, the resonance frequency ($f_0$) rises after temporary fall. In either case, there is a region where the resonance frequency ($f_0$) varies with a change in the amplitude of the diaphragm 20 (the shaded portions in FIGS. 33 and 34), and the output-to-input follow-up reproducibility is deteriorated in that region. When an electromagnetic type electroacoustic transducer with the above structure is used for an amplitude-modulated (AM sound) or an attenuating sound, there occurs a region where the desired sound pressure and/or timbre to an input cannot be reproduced.

This shortcoming occurs not only in the electromagnetic type electroacoustic transducer, but also in a piezo type electroacoustic transducer. In the piezo type electroacoustic transducer, an added mass is also attached to a piezo element or elastic plate in some cases to set the frequency of an output sound lower by the increased mass. In this case, the compliance of the portion around the added mass and that of the portion around the to-be-supported portion decrease with an increase in the amplitude of the diaphragm, causing the same problem as occurred in the case of the electromagnetic type electroacoustic transducer.

The prior art solutions to the above problem are disclosed in Examined Japanese Utility Model Publication No. 51-43807 (Reference 1), Examined Japanese Utility Model Publication No. 51-43808 (Reference 2), and Unexamined Japanese Patent Publication No. 60-220397 (Reference 3). References 1 and 2 disclose an art of using a thin layer as an added mass to provide elasticity to the outer peripheral portion of the added mass, so that a change in the compliance is suppressed when the amplitude of the diaphragm changes. In this case, however, dew condensation, freezing or rust will cause a large change in the compliance of the vibrating system. Reference 3 discloses an art of making that face of an added mass which contacts an elastic plate to have a curved surface with a curvature matching the curvature of the elastic plate in the attracted condition, thereby suppressing a rise of the resonance frequency ($f_0$) in the attracted condition, and suppressing a change in the compliance with an change in the amplitude of the diaphragm. But, in this prior art device, it is difficult to design the curved surface of the added mass and control the mass production of electroacoustic transducers.

SUMMARY OF THE INVENTION

It is therefore an object of the present invention to provide an electroacoustic transducer which can suppress a variation in the resonance frequency ($f_0$) by controlling a change in the spring characteristic with respect to the amplitude of a diaphragm, thereby improving the follow-up reproducibility of an output to an input.

To achieve this object, according to this invention, there is provided an electroacoustic transducer comprising a diaphragm including an added mass having a contact portion, which contacts an elastic plate and is shaped to provide a portion to allow for deformation of the elastic plate within an imaginary circle defined by connecting the outer surface portion of the contact portion.

The added mass may comprise a main body and projections protruding toward the elastic plate from the main body. The projections have flat surfaces to contact the elastic plate and the flat surfaces serve as the contact portion. The projections extend radially at a plurality of portions, providing a portion between adjoining extending portions of the projections to allow for deformation of the elastic plate.

In this case, the main body may have a shape similar to that of the projections as a whole.

Alternatively, added mass may comprise only projections protruding toward the elastic plate. The projections have flat surfaces to contact the elastic plate and the flat surfaces serve as the contact portion. The projections extend radially at a plurality of portions, providing a portion between adjoining extending portions of the projections to allow for deformation of the elastic plate.

The outer periphery of the flat surface of each projection has an arc shape with a proper radius of curvature.

Each projection has a radial length long enough to be inscribed in a node circle in a resonance mode of a specific resonance frequency of the diaphragm or slightly shorter than that length.

The electroacoustic transducer may be an electromagnetic type electroacoustic transducer or a piezo type electroacoustic transducer.

DETAILED DESCRIPTION OF THE PREFERRED EMBODIMENTS

Figure 1:
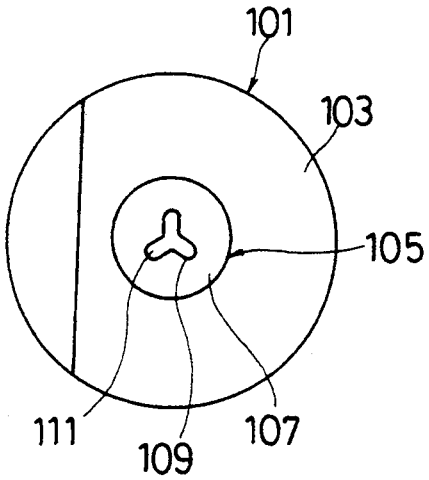
FIG. 1 is a plan view of a diaphragm illustrating one embodiment of the present invention.
Figure 2:
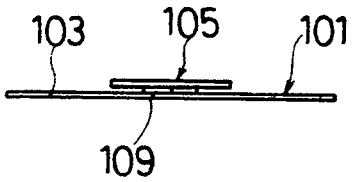
FIG. 2 is a side view of the diaphragm according to this embodiment.
Figure 3:
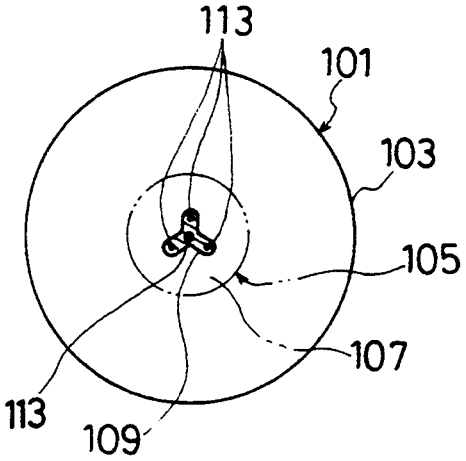
FIG. 3 is a plan view of the diaphragm illustrating welded portions of a magnetic piece according to this embodiment.
Figure 4:
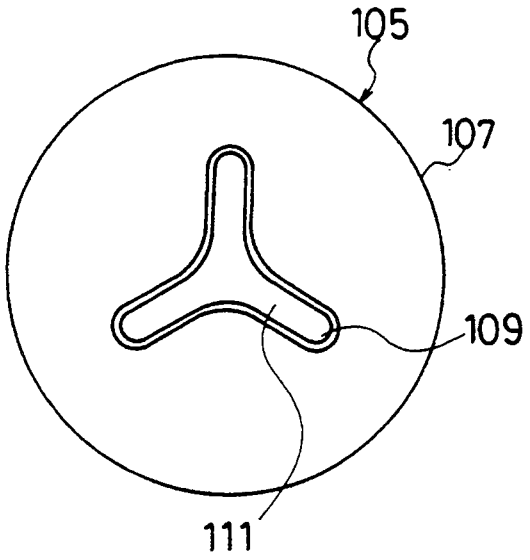
FIG. 4 is a plan view of the magnetic piece as viewed from the projection side according to this embodiment.
Figure 5:
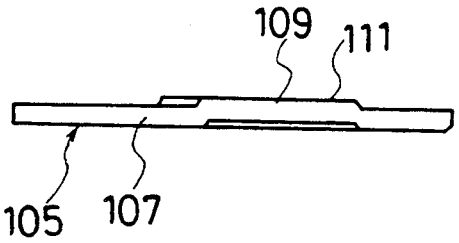
FIG. 5 is a side view of the magnetic piece according to this embodiment.
Figure 6:
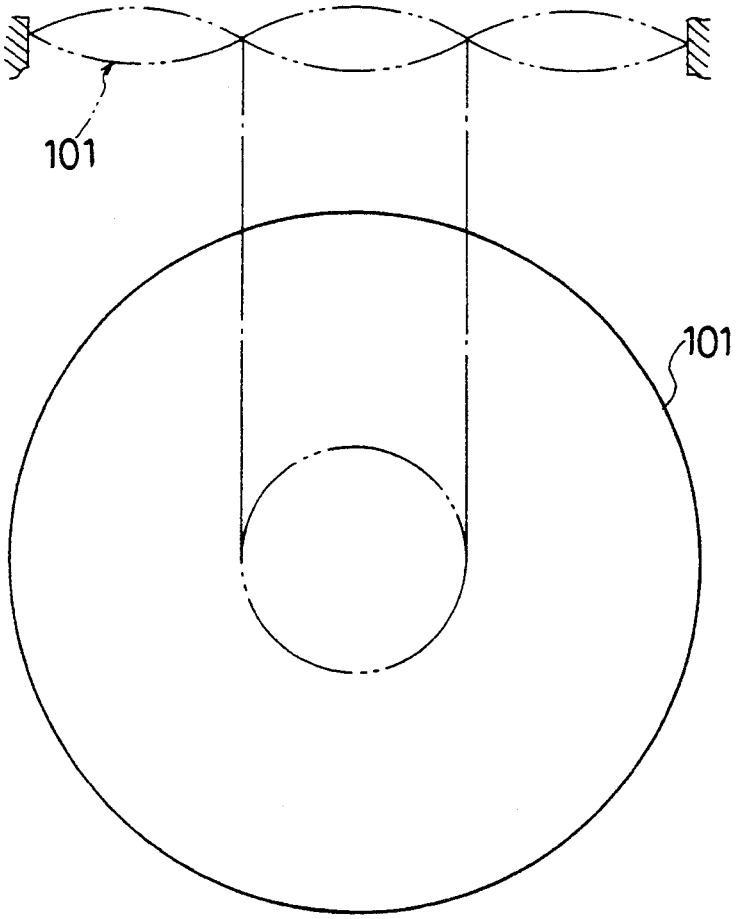
FIG. 6 is a diagram for explaining a node circle according to this embodiment.

One preferred embodiment of the present invention will now be described referring to FIGS. 1 through 8. In this embodiment, the present invention is applied to an electromagnetic type electroacoustic transducer. According to the electromagnetic type electroacoustic transducer of this embodiment, the structure of a diaphragm 101 is improved. The diaphragm 101 comprises an elastic plate 103 having a shape of a thin disk and made of magnetic metal, and a magnetic piece 105 attached as an added mass to this elastic plate 103. The magnetic piece 105 is also made of magnetic metal. As shown in FIGS. 4 and 5, the magnetic piece 105 includes a disk-shaped main body 107 and projections 109 protruding toward the elastic plate 103 from the main body 107. The projections 109 are arranged concentric to the main body 107, extending radially by a given length, spaced apart from one another at an angle of 120° C. Each projection 109 has a flat surface 111 on the side of the elastic plate 103, and contacts the elastic plate 103 through this surface 111. It is desirable that the radial length of each projection 109 is long enough to be inscribed in a "node circle" in a resonance mode of the specific resonance frequency of the diaphragm 101 or is slightly shorter than that length. The "node circle" will be discussed below. With a vibrating system as shown in FIG. 6, there is a resonance mode of the specific resonance frequency of the diaphragm 101 as shown in, for example, FIG. 6. In this case, a circle indicated by an imaginary line is the "node circle". For some vibrating systems, a plurality of concentric "node circles" may be generated; in this case, the "node circle" means the innermost circle. If the radial lengths of the projections 109 are made to extend beyond such a "node circle", the resonance mode of the specific resonance frequency of the diaphragm 101 would be interfered in vain. It is preferable that the outer periphery of the flat surface 111 of each projection 109 has an arc shape with the proper radius of curvature. This is because if the outer periphery is edge-shaped, stress would be concentrated on the edge portion during the repetitive vibration, lowering the reliability, but shaping the outer periphery in an arc to have the proper radius of curvature can prevent such stress concentration. The magnetic piece 105 is secured to the elastic plate 103 by spot welding at the positions corresponding to the radially extending projections 109 or the magnetic piece 105, as shown in FIG. 3. The welded portion is denoted by a numeral "113" in FIG. 3.

The action of the electromagnetic type electroacoustic transducer having the above structure will be described below. Since the basic action of the electromagnetic type electroacoustic transducer to output a predetermined sound with respect to an input is the same as that of the prior art, its description will not be given below. When the diaphragm 101 vibrates, the rigidity of the contact portion of the magnetic piece 105 having a sufficient thickness which is in contact with the elastic plate 103 increases, making the contact portion difficult to deform. That is, the deformable area of the diaphragm 101 is limited to the portion outside the contact portion to the magnetic piece 105. In the prior art, the magnetic piece 21 is shaped like a disk so that when the diaphragm 20 vibrates, the whole disk portion of the magnetic piece 21 contacts the elastic plate 19. The deformable area of the diaphragm 20 is therefore only the portion outside the circle. According to this embodiment, in contrast, the magnetic piece 105 contacts the elastic plate 103 only through the flat faces 111 of the projections 109, so that there still exist deformable elastic-plate portions between the adjoining radially-extending portions of the projections 109, i.e., in an area inside the circle. In other words, a deformable area exists outside the circle as in the prior art while such a deformable area also exists inside the circle.

Let us now compare the deformable elastic-plate portion in the area inside the circle with the deformable elastic-plate portion outside the circle as in the prior art. As tension is applied to the former deformable portion differently from the latter one and the deformation is suppressed by the projections 109 of the magnetic piece 105, the former deformable portion is considered to have a smaller compliance and a different spring characteristic than the conventional deformable portion outside the circle. As the whole portion of the elastic plate 103 is of the same member, the elastic plate 103 is continuous as a spring. In other words, the elastic plate 103 is structured as if by connecting different springs having different spring characteristics. The compliance continuously changes toward the area inside the circle from the area outside it. Even when the diaphragm having such an added mass of the present invention vibrates, the tensions around the added mass and the to-be-supported portion increase (i.e., the compliance decreases) as in the prior art having a circular added mass when the amplitude of the diaphragm is increased. It should however be noted that the tension generated around the added mass does not affect the area outside the circle circumscribing the projections 109 of the added mass, which is the node circle in resonance mode, due to the deformation of the elastic plate 103 within the circle. It is therefore possible to suppress a change in the resonance frequency ($f_0$) with a change in the amplitude of the diaphragm to stabilize the frequency until the tension generated around the added mass by the vibration affects the compliance of the elastic plate 103 outside the node circle in resonance mode.

Figure 7:
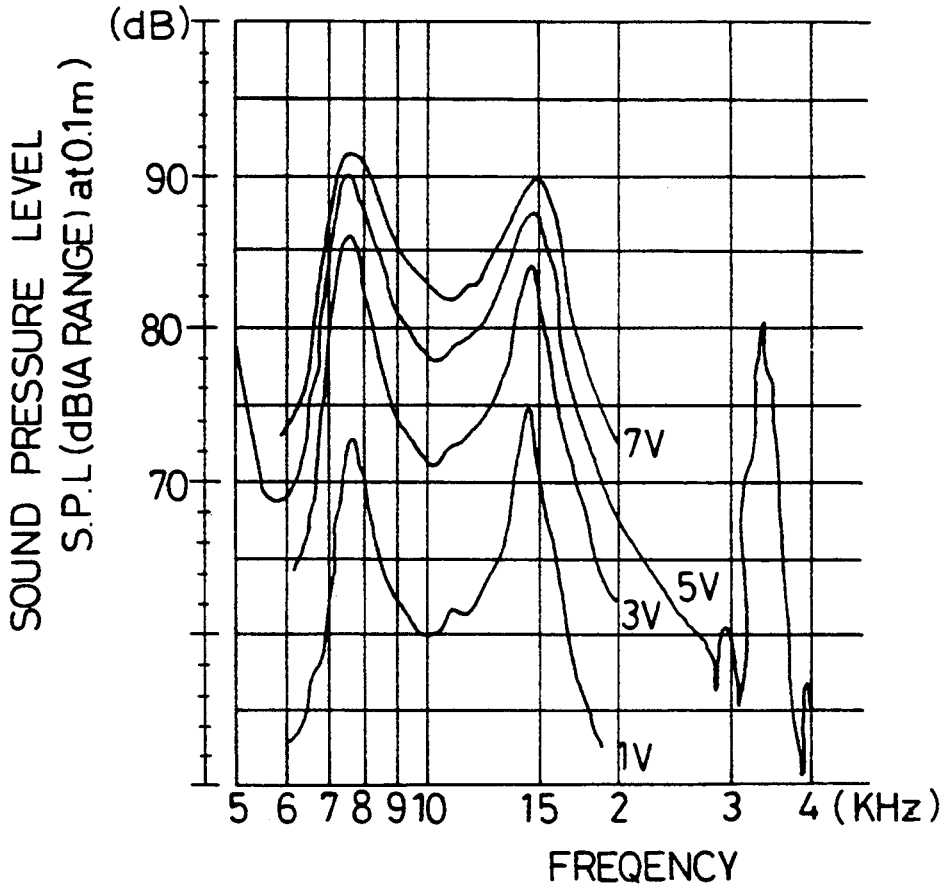
FIG. 7 is a characteristic chart showing a variation in resonance frequency ($f_0$) with a change in the amplitude of the diaphragm according to this embodiment.
Figure 8:
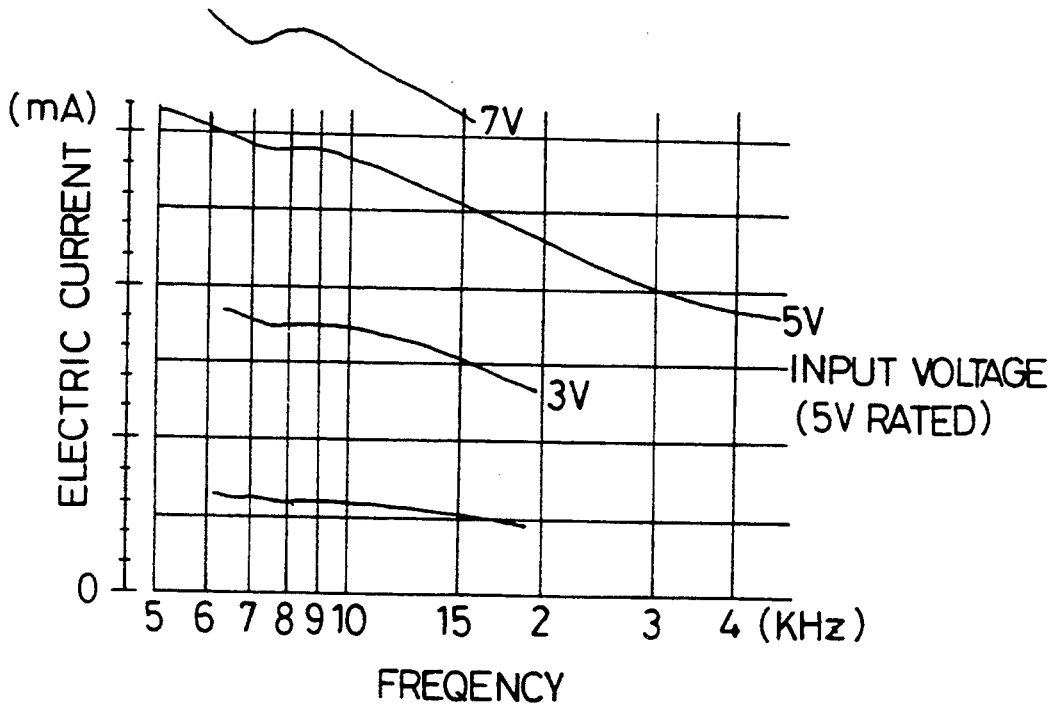
FIG. 8 is a characteristic chart showing the characteristic of an applied voltage according to this embodiment.
Figure 9:
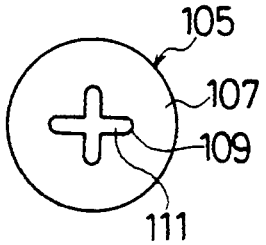
FIG. 9 is a plan view of a magnetic piece as viewed from the projection side according to another embodiment of this invention.
Figure 10:
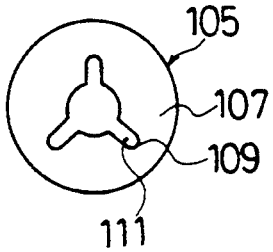
FIG. 10 is a plan view of a magnetic piece as viewed from the projection side according to a still another embodiment of this invention.
Figure 11:
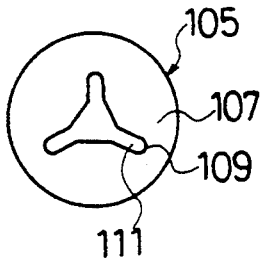
FIG. 11 is a plan view of a magnetic piece as viewed from the projection side according to a further embodiment of this invention.
Figure 12:
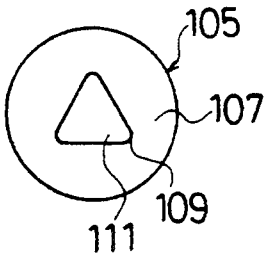
FIG. 12 is a plan view of a magnetic piece as viewed from the projection side according to a still further embodiment of this invention.
Figure 13:
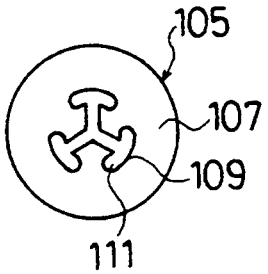
FIG. 13 is a plan view of a magnetic piece as viewed from the projection side according to a yet still further embodiment of this invention.
Figure 14:
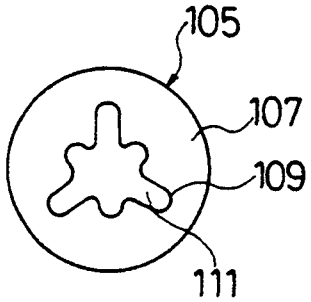
FIG. 14 is a plan view of a magnetic piece as viewed from the projection side according to a yet still further embodiment of this invention.
Figure 15:
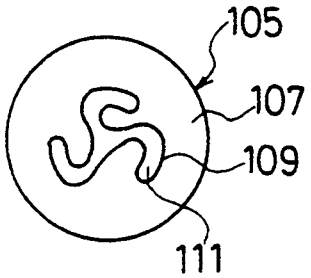
FIG. 15 is a plan view of a magnetic piece as viewed from the projection side according to a yet still further embodiment of this invention.
Figure 16:
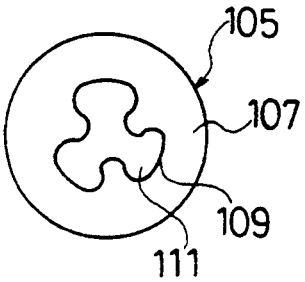
FIG. 16 is a plan view of a magnetic piece as viewed from the projection side according to a yet still further embodiment of this invention.
Figure 17:
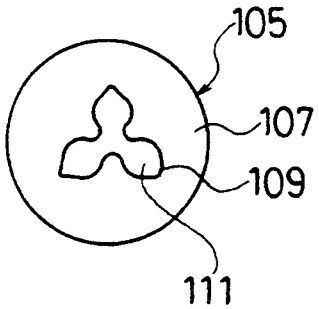
FIG. 17 is a plan view of a magnetic piece as viewed from the projection side according to a yet still further embodiment of this invention.

In short, this embodiment has the following advantages. First, as the radially extending projections 109 are provided on the magnetic piece 105 so that the magnetic piece 105 contacts the elastic plate 103 only through the flat faces 111 of the projections 109, a deformable elastic-plate portion can still be provided within the node circle. This can suppress a change in resonance frequency ($f_0$) with a change in the amplitude of the diaphragm. Accordingly, the follow-up reproducibility of an output to an input can be improved sufficient enough to cope with the case of using the electroacoustic transducer for AM sounds or attenuating sounds. FIG. 7 illustrates the results of experiments which show that a variation in resonance frequency ($f_0$) with a change in the amplitude of the diaphragm is suppressed and stabilized. It is apparent from FIG. 7 that even when the amplitude of the diaphragm changes (a change in the applied voltage: 1 V, 3 V, 5 V and 7 V), the resonance frequency ($f_0$) is stable. The characteristic of the applied voltage at that time is shown in FIG. 8.

The stable resonance frequency ($f_0$) with respect to a change in the amplitude of the diaphragm means that the resonance frequency ($f_0$) is stable even for various variations (variations in components themselves, variation in assembly, etc.) that would change the amplitude of the diaphragm. Even if there is a slight variation in components or in assembly, thus, there is a less variation in the characteristic of the complete product. This will be explained more specifically. The variations in components include a variation in coil winding and a variation in material. The variation in coil winding affects a variation in inductance and a variation in resistance. The variation in material affects a variation in thickness and a variation in the spring characteristic. The variation in assembly includes a variation caused during working, such as bending by pressing or a change in size by caulking. Even if the amplitude of the diaphragm changes due to those variations, the resonance frequency ($f_0$) can be stabilized. Further, since the contact area of the magnetic piece 105 to the elastic plate 103 is reduced, there is a less chance of any foreign matter entering the clearance therebetween and the change in the characteristic due to such foreign matter becomes smaller.

Figure 18:
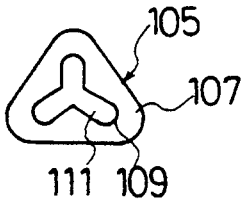
FIG. 18 is a plan view of a magnetic piece as viewed from the projection side according to a yet still further embodiment of this invention.
Figure 19:
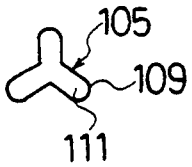
FIG. 19 is a plan view showing a magnetic piece constituted only of projections according to a yet still further embodiment of this invention.
Figure 20:
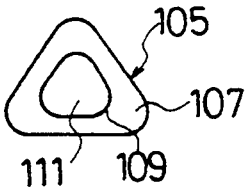
FIG. 20 is a plan view of a magnetic piece as viewed from the projection side according to a yet still further embodiment of this invention.
Figure 21:
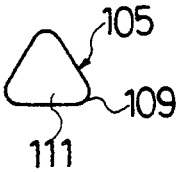
FIG. 21 is a plan view showing a magnetic piece constituted only of projections according to a yet still further embodiment of this invention.
Figure 22:
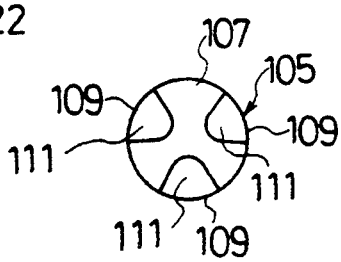
FIG. 22 is a plan view showing a magnetic piece from the projection side according to a yet still further embodiment of this invention.
Figure 23:
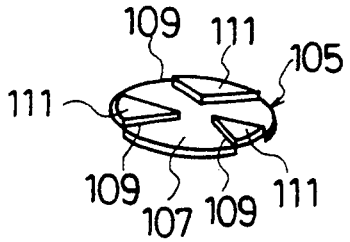
FIG. 23 is a perspective view of the magnetic piece shown in FIG. 22.
Figure 24:
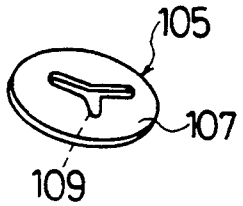
FIG. 24 is a perspective view of a magnetic piece as viewed from the opposite side to projections according to a yet still further embodiment of this invention.
Figure 25:
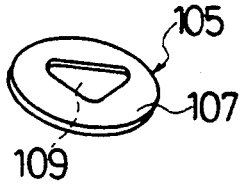
FIG. 25 is a perspective view of a magnetic piece as viewed from the opposite side to projections according to a yet still further embodiment of this invention.
Figure 26:
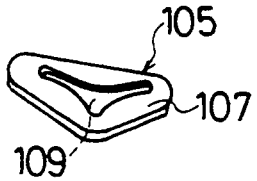
FIG. 26 is a perspective view of a magnetic piece as viewed from the opposite side to projections according to a yet still further embodiment of this invention.
Figure 27:
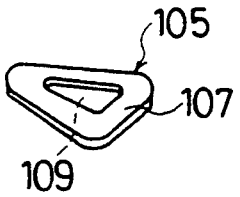
FIG. 27 is a perspective view of a magnetic piece as viewed from the opposite side to projections according to a yet still further embodiment of this invention.

The present invention is not limited to the above-described embodiment. Although the elastic plate 103 and the magnetic piece 105 are both made of magnetic metals, only one of them may be made of magnetic metal. For instance, the elastic plate 103 may be made of magnetic metal while the magnetic piece 105 may be made of hard rubber or the like. Further, the projections 109 of the magnetic piece 105 may be shaped as shown in FIGS. 9 through 17 instead of the illustrated one of the first embodiment. The spring characteristic can be altered by changing the number of projections 109 or the shape of each projection 109. The modification of the projections 109 would change the frictional resistance produced by the contact faces 111, thus changing the spring characteristic. The main body 107 of the magnetic piece may be designed to have a shape similar to the shape of the projections 109 as a whole, as shown in FIGS. 18 and 20. If the entire weight of the magnetic piece 105 and the center of gravity thereof can be made the same as those of projections 109, the magnetic piece 105 may be the projections 109 themselves as shown in FIGS. 19 and 21. In other words, the disk-shaped main body 107 is eliminated and the magnetic piece 105 is constituted only of the projections 109. Those designs are effective when the horizontal fluctuation of the magnetic piece 105 and the amplitude are so large that the outer periphery of the main body 107 contacts the elastic plate 103. As shown in FIGS. 22 and 23, the projections 109 may be provided by making those portions of the main body 107 other than the projections 109 protrude in the opposite direction to the surface that contacts the elastic plate 103. Furthermore, the main body 107 may be designed so that those portions of the main body 107 opposite the contact surfaces of the projections 109 are recessed, as shown in FIGS. 24 through 27.

Figure 28:
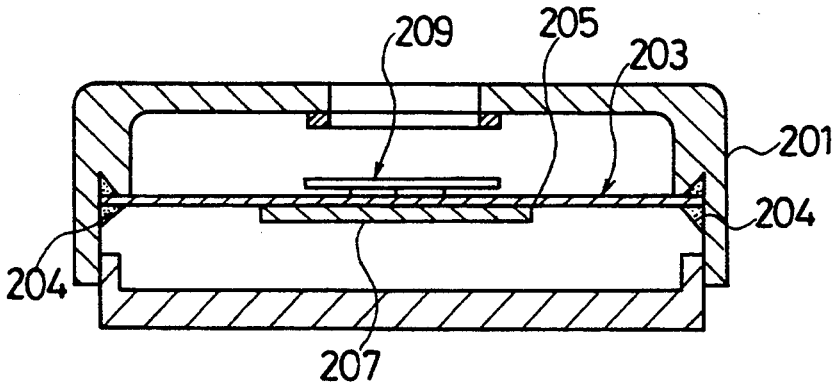
FIG. 28 is a cross-sectional view illustrating a different embodiment of this invention as applied to a piezo type electroacoustic transducer.
Figure 29:
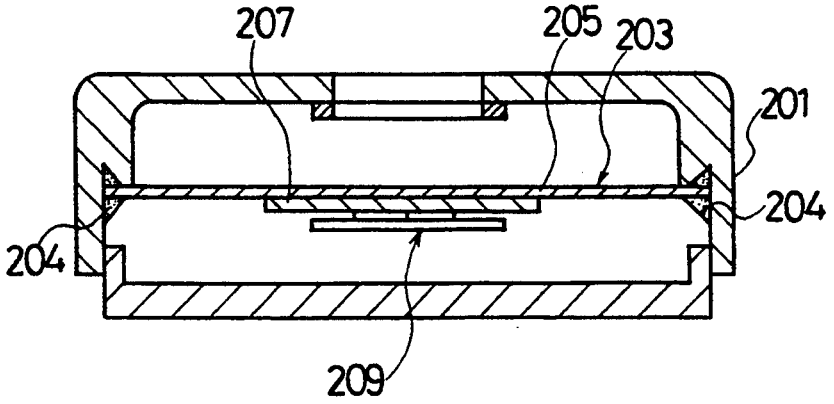
FIG. 29 is a cross-sectional view illustrating a still different embodiment of this invention as applied to a piezo type electroacoustic transducer.
Figure 30:
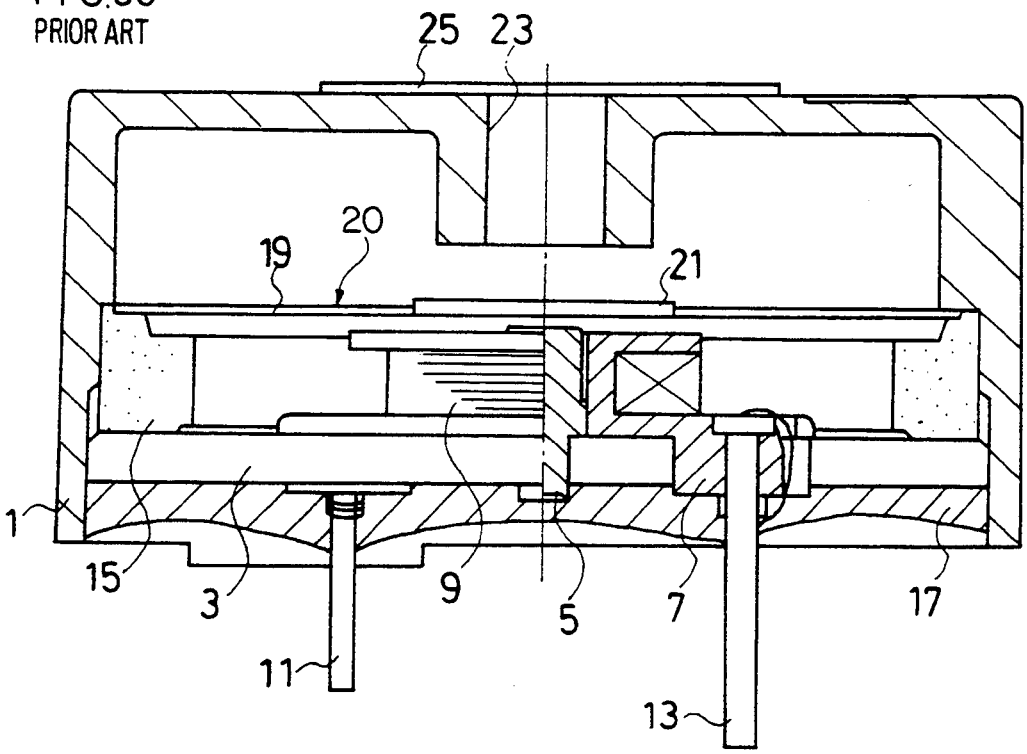
FIG.30 PRIOR ART
FIG. 30 is a cross section of a conventional electromagnetic type electroacoustic transducer.
Figure 31:
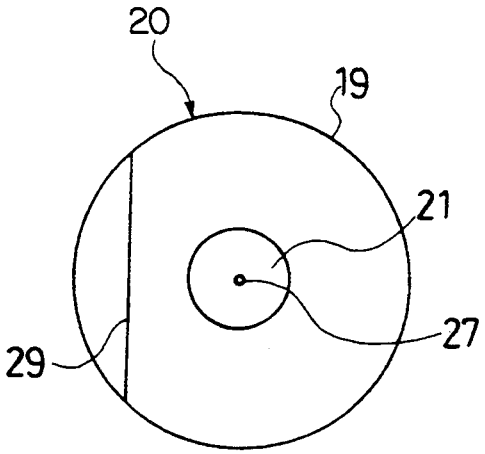
FIG.31 PRIOR ART
FIG. 31 is a plan view of a diaphragm of the prior art.
Figure 32:
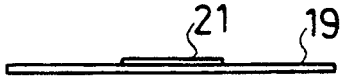
FIG. 32 PRIOR ART
FIG. 32 is a side view showing the diaphragm of the prior art.
Figure 33:
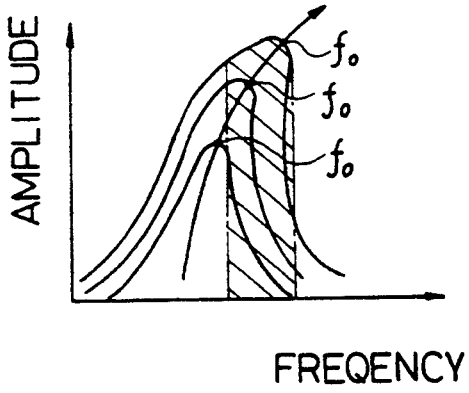
FIG. 33 PRIOR ART
FIG. 33 presents a characteristic chart showing a variation in resonance frequency ($f_0$) with a change in the amplitude of the diaphragm according to the prior art.
Figure 34:
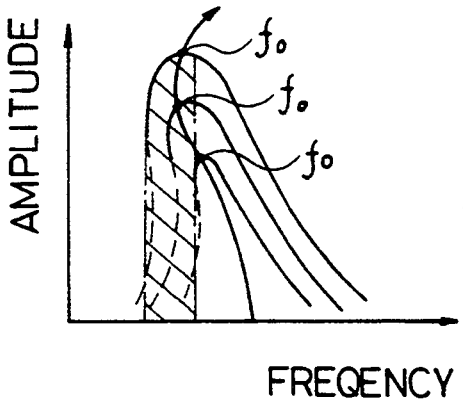
FIG. 34 PRIOR ART
FIG. 34 presents another characteristic chart showing a variation in resonance frequency ($f_0$) with a change in the amplitude of the diaphragm according to the prior art.

The present invention is applicable to a piezo type electroacoustic transducer as well as the electromagnetic type electroacoustic transducer. The application to the piezo type is illustrated in FIG. 28. This electroacoustic transducer has a case 201 in which a diaphragm 203 having the outer peripheral portion secured to the inner wall of the case 201 by an adhesive 204 or the like. This diaphragm 203 comprises an elastic plate 205 and a piezo element 207 attached to this plate 205. An added mass 209 with the diaphragm structure of this invention is attached to the that side of the elastic plate 205 opposite to the piezo element 207. This added mass 209 has the same shape as the magnetic piece 105 in the first embodiment. In this case, however, since there is no need to use a magnetic piece, it is shown simply as the added mass 209. This structure can allow the spring characteristic of the diaphragm 203 to be controlled to suppress and stabilize a variation in resonance frequency ($f_0$) caused by a change in the amplitude of the diaphragm as in the first embodiment. FIG. 29 illustrates a modification of the piezo type electroacoustic transducer embodying this invention. In this modification, the added mass 209 is attached to the piezo element 207. This modification has the same advantages as the one shown in FIG. 28. In the case of a piezo type electroacoustic transducer, the piezo element 207 itself may be shaped similar to the added mass 209, though not illustrated. In this case, the piezo element 207 serves as an added mass in addition to the original function of the piezo element 207. If the piezo element 207 is designed to have a shape similar to the shape of the projections of the present invention as a whole, the spring characteristic of the diaphragm 203 can be controlled to suppress and stabilize a variation in resonance frequency ($f_0$) caused by a change in the amplitude of the diaphragm.

What is claimed is:

1. An electroacoustic transducer comprising a diaphragm including an elastic plate and an added mass secured to a center portion of said elastic plate, said added mass having a contact portion which contacts said elastic plate, is non-circular in shape, and extends and is developed in at least three directions, in such a way as to provide portions that allow for deformation of said elastic plate within an imaginary circle, wherein said imaginary circle entirely contains said contact portion and circumscribes outer peripheral portions of said contact portion.

2. The electroacoustic transducer as claimed in claim 1, wherein said added mass has a flat surface which contacts said elastic plate, said flat surface having a same shape as a horizontal sectional shape of said added mass, and serving as said contact portion.

3. The electroacoustic transducer as claimed in claim 1, wherein said added mass comprises a main body and a projection protruding toward said elastic plate from said main body, said projection has a flat surface to contact said elastic plate, said flat surface serving as said contact portion.

4. The electroacoustic transducer as claimed in claim 3, wherein said main body has a shape similar to that of said projection as a whole.

5. The electroacoustic transducer as claimed in any one of claims 1 to 3, wherein said non-circular contact portion is radially extending and developed in three directions.

6. The electroacoustic transducer as claimed in any one of claims 1 to 3, wherein said contact portion is nearly triangular in shape.

7. The electroacoustic transducer as claimed in any one of claims 1 to 3, wherein said non-circular contact portion is extending and developed in three directions, having ends of the extended portions bent.

8. The electroacoustic transducer as claimed in any one of claims 1 to 3, wherein a circumscribing circle of said contact portion is equal in size to or slightly smaller than a node circle in a resonance mode of a specific resonance frequency of said diaphragm.

9. The electroacoustic transducer as claimed in any one of claims 1 to 3, wherein said contact portion has an outer periphery made in an arc shape with a proper radius of curvature.

10. The electroacoustic transducer as claimed in any one of claims 1 to 3, said electroacoustic transducer is an electromagnetic type electroacoustic transducer.

11. The electroacoustic transducer as claimed in any one of claims 1 to 3, said electroacoustic transducer is a piezo type electroacoustic transducer.

12. The electroacoustic transducer as claimed in any one of claims 1 to 3, wherein said portions that allow for deformation of said elastic plate are provided, well balanced, in a circumferential direction.

* * * * *